US005593528A

United States Patent [19]

Dings et al.

[11] Patent Number: 5,593,528

[45] Date of Patent: Jan. 14, 1997

[54] METHOD OF PROVIDING A PATTERN OF APERTURES AND/OR CAVITIES IN A PLATE OR LAYER OF NON-METALLIC MATERIAL

[75] Inventors: Jacobus M. Dings; Remko Horne; Gerardus N. A. Van Veen; Joseph C. M. Bosman, all of Eindhoven, Netherlands

[73] Assignee: U.S. Philips Corporation, New York, N.Y.

[21] Appl. No.: 359,377

[22] Filed: Dec. 20, 1994

[30] Foreign Application Priority Data

Dec. 20, 1993 [BE] Belgium ..... 09301422

[51] Int. Cl.[6] ..... B24C 1/00

[52] U.S. Cl. ..... 156/154; 156/153; 451/29; 451/31; 451/38; 451/78

[58] Field of Search ..... 156/153, 154; 451/29, 30, 31, 78, 38

[56] References Cited

U.S. PATENT DOCUMENTS

| | | | |
|---|---|---|---|
| 2,106,979 | 2/1938 | Kavanaugh | 451/31 X |
| 4,232,059 | 11/1980 | Proffitt | 427/96 |
| 4,612,737 | 4/1986 | Adee et al. | 451/29 |

FOREIGN PATENT DOCUMENTS

| | | | |
|---|---|---|---|
| 0562670 | 9/1993 | European Pat. Off. . | |
| 2644194 | 9/1990 | France . | |
| 60-20861 | 2/1985 | Japan | 451/31 |
| 632097 | 2/1994 | Japan | 156/154 |

*Primary Examiner*—Jeff H. Aftergut
*Attorney, Agent, or Firm*—Robert J. Kraus

[57] ABSTRACT

After a plate or layer of non-metallic, particularly hard and brittle material has been provided with a (metal) mask having a plurality of apertures arranged in a pattern, it is exposed to at least one jet of abrasive powder particles, which jet is moved relative to the plate. The mask has its surface facing the surface on which the jet impinges secured to the plate or layer of non-metallic material by means of a layer of adhesive material having a thickness which is smaller than the size of the abrasive powder particles.

8 Claims, 2 Drawing Sheets

METHOD OF PROVIDING A PATTERN OF APERTURES AND/OR CAVITIES IN A PLATE OR LAYER OF NON-METALLIC MATERIAL

BACKGROUND OF THE INVENTION

The invention relates to a method of providing a plurality of cavities and/or apertures arranged in a pattern in a plate or layer of non-metallic, particularly hard and brittle material.

Plates or layers of this type, which may particularly be made of hard, brittle materials such as glass, (oxidic) or ceramic material, are particularly used in micro-electronic devices such as electro-luminescent gas discharge displays (plasma displays), in field emission displays, cathode ray displays and in displays in which electrons are propagated in ducts having walls of electrically insulating material (referred to as insulating electron duct displays) in which the apertures or cavities are used for manipulating electron currents. They may be formed as (multi-apertured) control plates and provided with (addressable) electrodes cooperating with the apertures, as transport plates having a plurality of parallel cavities (transport ducts), or as apertured spacers (for example, between a control plate and the luminescent screen of a luminescent display).

U.S. Pat. No. 4,388,550 describes a luminescent gas discharge display. This display requires a control plate controlling the individual pixels. This control plate divides the inner space of such displays into two areas, a plasma area and a post-acceleration area. It comprises a "perforated" plate having an array of lines at one side and at the other side an array of columns of metal conductors or electrodes surrounding or extending along the perforations. These enable electrons to be selectively extracted from the plasma area through the apertures to the post-acceleration area and to be incident on the luminescent screen. Other gas discharge displays comprise, for example plates having (facing) cavities.

In a control plate, the number of perforations or apertures in a plate of the type described above is defined by the number of desired pixels.

Present-day television line scan patterns use, for example approximately 500×700 pixels having a horizontal pitch of 0.5 mm and a vertical pitch of 0.7 mm. These pixels define the pattern of apertures to be provided in the control plate of electrically insulating material.

It is known from EP 0 562 670 that these patterns can be manufactured by means of an apertured mask and a powder spray process. This process is possible by virtue of the large difference in production rate between the (metallic) mask material and the (non-metallic) material of the object which is to be provided with a pattern of apertures (particularly glass). A problem which appears to occur when using a (metal) mask which is glued onto the plate to be patterned is, however, that the mask is sometimes (locally) detached during spraying, inter alia, with the result that it is no longer seated correctly on the product to be provided with a pattern, which is at the expense of the accuracy of this pattern. Also when the mask is not detached, there is the problem that the apertures made often become larger than is desirable.

SUMMARY OF THE INVENTION

It is an object of the invention to provide a (preferably simple) method of manufacturing a plate which is particularly suitable for the uses described hereinbefore and mitigates the above-mentioned problems.

The method according to the invention is therefore characterized in that the pattern is made by means of the following steps:

producing at least one jet of abrasive powder particles;

directing the jet onto a surface of the plate or layer;

limiting the areas where the jet impinges upon the surface;

performing a relative movement between the jet and the plate, using a mask for limiting the areas where the jet impinges upon the surface, which mask has its surface facing the surface on which the jet impinges secured to the plate or layer of non-metallic material by means of a layer of adhesive material having a thickness which is smaller than the size of the abrasive powder particles.

The invention is based on the recognition that there is "underspraying" or "underetching" during the spraying process, which is caused by the fact that the abrasive powder particles remove parts from the adhesive layer during spraying. As a result, powder particles may get underneath the mask, so that this mask is locally detached. Moreover, these particles may attack the parts which are not to be sprayed.

The apertures to be made will consequently become larger than is desirable. By using a very thin adhesive layer having a thickness which is smaller than the size of the abrasive powder particles, said unwanted phenomena hardly appear to occur.

When a separate (metal) plate is used as a mask, it is advantageous to stick this mask onto the plate to be sprayed by means of an adhesive which can easily be removed after the spraying process. (For example, glucose-based adhesives can easily be removed with water).

If the (metal) mask is glued by means of a thin adhesive layer, it is important that the adhesive strength of the adhesive is sufficient to prevent detaching of the object to be patterned due to build-up of mechanical tensions in the mask. This may particularly occur in masks having a high transmission (small gluing surface).

In those cases where the thickness of an adhesive layer based on glucose must be chosen to be so thin (in connection with the size of the powder particles to be sprayed) that the adhesive strength might be insufficient (which thus also depends on the available adhesive surface), an acetate-based locking agent may alternatively be used (of which polyvinyl chloride acetate which is soluble in acetone is an example). Such a locking agent may advantageously be spincoated in a diluted state in layers having a thickness of several microns. Said polyvinyl chloride acetate can satisfactorily be diluted with, for example, methyl ethyl ketone.

BRIEF DESCRIPTION OF THE DRAWINGS

These and other aspects of the invention will be apparent from and elucidated with reference to the embodiments described hereinafter.

In the drawings.

DESCRIPTION OF THE PREFERRED EMBODIMENT

Electrically insulating (particularly glass) control plates, transport plates and/or spacer plates having very accurate patterns of apertures and/or cavities are required for use in different types of (electroluminescent) displays. The plate thickness may be between 50 and 5000 microns, particularly between 50 and 700 microns. A characteristic material for these applications is glass or ceramic material.

Figure 1:
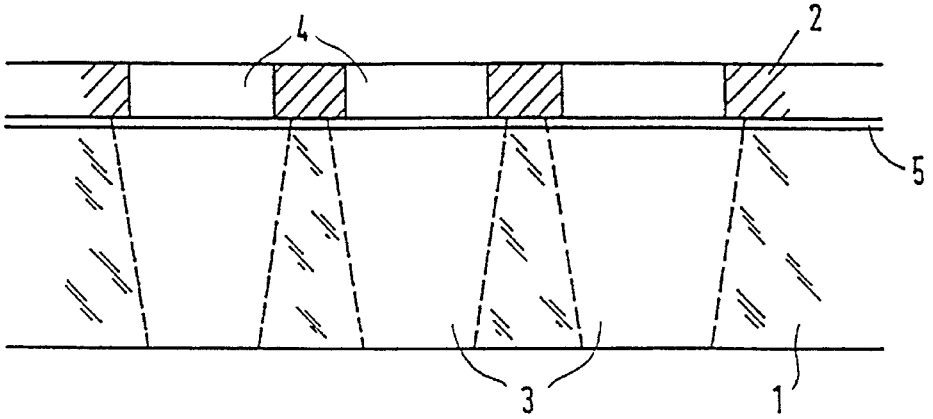
FIG. 1 is a cross-sectional view of a plate provided with a perforated mask.

FIG. 1 is a cross-sectional view of a glass plate 1 of 0.7 mm thick, provided with a metal mask 2. Suitable metals are those which are easily etchable, such as Fe and Fe alloys. They preferably exhibit little "shot peening". In this respect, Akoca (trademark) is a suitable material.

The mask 2 is secured to the plate 1 by means of an adhesive layer 5 so as to inhibit local detaching during the powder spraying process. The adhesive layer 5 may comprise an adhesive which is soluble in water (for example, an adhesive based on glucose). Such an adhesive can be easily provided at low cost and simply removed after use.

The apertures 3 denoted by broken lines in the plate 1 are slightly tapered in the embodiment of FIG. 1. When plates are used as internal vacuum supports (spacer plates) in field emission displays, such an aperture shape is not unusual. However, it is alternatively possible to make substantially cylindrical apertures or cavities with substantially parallel walls. Plates having cylindrical apertures are suitable, for example, as spacers between a control plate and the luminescent screen in an insulating electron duct display.

In the situation shown in FIG. 1, the upper sides of the apertures 3 have become larger during the powder spraying process than the apertures 4 in the mask. This is due to "underspraying", in which powder particles having an average size which is smaller than the thickness of the layer 5 remove parts of the material of the adhesive layer 5, so that powder particles may get underneath the mask 5 and may attack parts of the plate 1 which are not to be sprayed.

Figure 2:
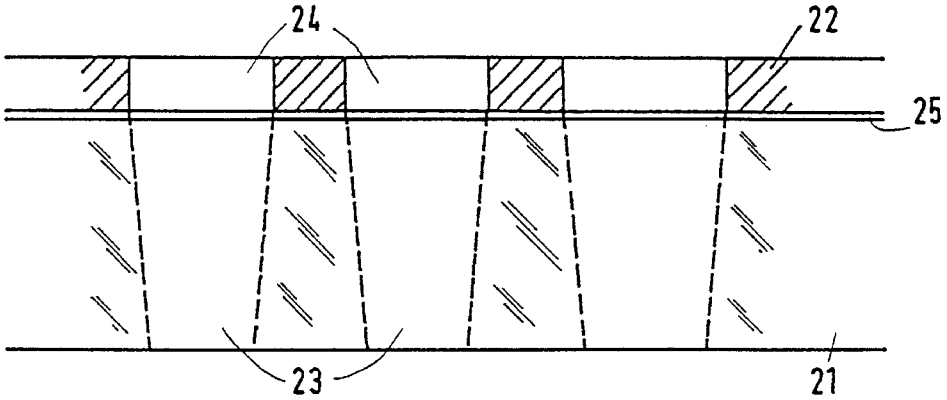
FIG. 2 is a cross-sectional view of a second plate provided with a perforated mask.

In the situation shown in FIG. 2, this underspraying phenomenon is prevented. Also in this case a perforated metal mask (22) is glued onto a (0.7 mm thick) glass plate (21 ) by means of an adhesive layer (25), but the adhesive layer 25 now has a smaller thickness than the size of the powder particles used in the spraying process. The thickness is preferably smaller than half, or even smaller than a third of the particle size. A glucose-based adhesive layer 25 having a thickness of 10 microns was used, for example, in a spraying process with particles having an average size of 30 microns, and a 5 microns thick polyvinyl chloride acetate adhesive layer 25 provided by means of spincoating was used in a spraying process with particles having an average size of 17 microns. There was no underspraying in these cases, as is shown in FIG. 2.

Figure 3:
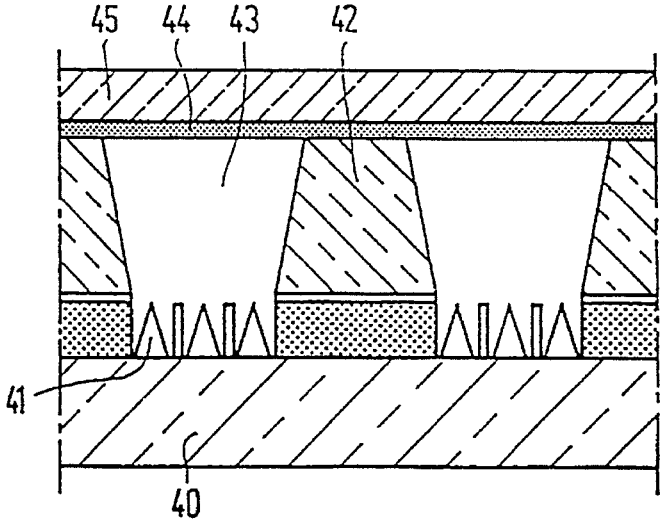
FIG. 3 is a cross-sectional view of a field emission display.

FIG. 3 is a diagrammatic cross-sectional view of a field emission display comprising a substrate 40, conical emission tips 41, a spacer plate 42 with apertures 43 and a front wall 45 with a luminescent screen 44. The spacer plate 42 may advantageously be made by means of the method according to the invention.

Figure 4:
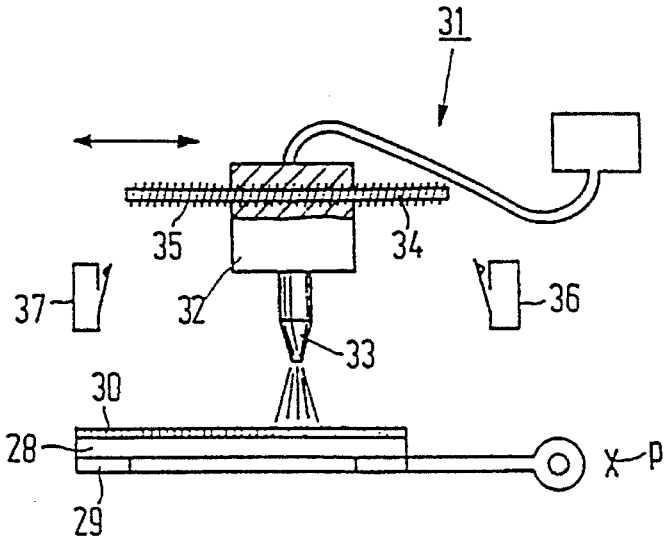
FIGS. 4 and 5 show diagrammatically how a pattern of apertures is provided in a plate by means of a powder spraying device.
Figure 5:
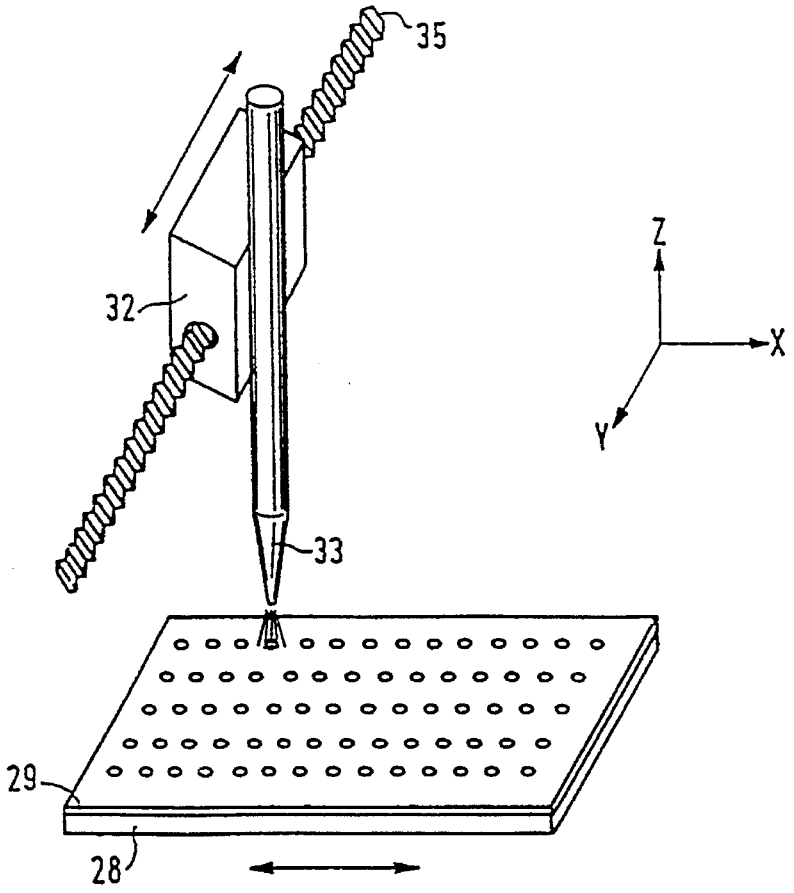

FIG. 4 shows a plate 28 to be sprayed, which plate is positioned on a support 29. The support 29 is movable in the direction of the arrow P perpendicular to the plane of the drawing. The plate 28 is provided with a mask 30 having the shape of a perforated metal plate. In this example, the mask 30 has a regular pattern of circular apertures (see FIG. 5). A device 31 for performing an abrasive operation (powder spraying device) is shown diagrammatically as a spraying unit 32 having a nozzle 33 directed onto the surface of the plate 28. Dependent on, for example, whether apertures or cavities are to be made, the nozzle/mask distance may range between 0.5 and 25 cm, typically between 2 and 5 cm. During operation a jet of abrasive powder particles, for example silicon carbide particles, aluminium oxide particles, granulated glass, granulated steel or mixtures thereof is blown from the nozzle 33. A pressure principle or a venturi principle may be used for this purpose. Abrasive particle dimensions suitable for the object of the invention range between 1 and 200 microns, typically between 10 and 100 microns.

In this embodiment spraying unit 32 with nozzle 33 can be traversed in a direction transverse to the arrow P by means of a traversing device 34 which has a spindle 35, but other ways of motion are alternatively applicable.

Stops provided with electric contacts are denoted by the reference numerals 36 and 37 and are assumed to be connected to a reversing circuit so as to reverse the sense of rotation of the spindle 35 to be driven by a motor.

During operation, the support 29 and the plate 28 make a, for example reciprocating movement parallel to the X axis and the spraying unit 32 performs axial traversing movements parallel to the Y axis (FIG. 5), the speeds of movement being adapted to each other in such a way that the complete desired aperture or cavity pattern is obtained in the plate 28. Instead of one nozzle, it is possible (for example, for the purpose of accelerating the process, but particularly for a better homogeneity of the desired pattern) to use a number of nozzles. This number may be 4 or 6, but may alternatively be 100. For a good homogeneity it is useful that each nozzle is moved across each piece of the mask.

The inventive method is also applicable, for example, when "cutting" (cylindrical) discs from plates, as is done, inter alia, when manufacturing diode bodies. Also in these cases it may be important to prevent underspraying, which phenomenon may detrimentally influence the correct dimensions of the discs.

We claim:

1. A method of manufacturing a display device including a luminescent screen and at least one plate comprising a non-metallic material having a predefined pattern of precisely-positioned passages through which charged particles are guided to effect excitation of the screen, characterized in that the passages are made by means of the following steps:

a. securing to the plate, by means of an adhesive layer, a mask having apertures arranged in the predefined pattern and having areas substantially corresponding to cross-sectional areas of the passages, said adhesive layer having a predetermined thickness;

b. producing at least one jet of abrasive-powder particles having a predetermined average size;

c. directing the at least one jet at a surface of the plate through the apertures in the mask;

d. performing a relative movement between the at least one jet and the plate to effect formation of the passages; and e. removing the mask from the plate;

said adhesive layer thickness being smaller than said abrasive-powder particle size.

2. A method as in claim 1 where the mask comprises a metallic material.

3. A method as in claim 1 where the at least one plate comprises a brittle material.

4. A method as in claim 3 where the at least one plate comprises an electrically-insulating material.

5. A method as in claim 1 where the adhesive layer thickness is smaller than one-half of the abrasive-powder particle size.

6. A method as in claim 5 where the adhesive layer thickness is smaller than one-third of the abrasive-powder particle size.

7. A method as in claim 1 where the adhesive layer consists essentially of a glucose-based material.

8. A method as in claim 1 where the adhesive layer consists essentially of an acetate-based material.

* * * * *